US007849529B2

(12) United States Patent
Bedard

(10) Patent No.: US 7,849,529 B2
(45) Date of Patent: Dec. 14, 2010

(54) AIR INJECTOR SYSTEM APPARATUS AND METHODS FOR A TUB OR SPA

(76) Inventor: Paul R. Bedard, 1120 SE. 7th Ave., Pompano Beach, FL (US) 33323

( * ) Notice: Subject to any disclaimer, the term of this patent is extended or adjusted under 35 U.S.C. 154(b) by 859 days.

(21) Appl. No.: 11/105,870

(22) Filed: Apr. 14, 2005

(65) Prior Publication Data

US 2006/0230517 A1 Oct. 19, 2006

(51) Int. Cl.
*A61H 33/02* (2006.01)

(52) U.S. Cl. ..... 4/541.5; 4/541.1

(58) Field of Classification Search ..... 4/541.1, 4/541.3, 541.4, 541.5, 541.6, 584; 239/565, 239/566

See application file for complete search history.

(56) References Cited

U.S. PATENT DOCUMENTS 4,586,204 A * 5/1986 Daniels ..... 4/541.4
4,901,379 A * 2/1990 Chalberg et al. ..... 4/541.5
5,809,648 A * 9/1998 Kurth et al. ..... 4/541.6 X

* cited by examiner

*Primary Examiner*—Robert M Fetsuga

(57) ABSTRACT

Apparatus and methods include an array of a plurality of individual air injector nozzles are integrally connected to a common air flow tube. The individual nozzles include an integral attaching plate and an integral air injector tube in addition to the common air flow tube with the individual nozzles spaced along the common air flow tube. A plurality of arrays can be joined together to form an entire arrangement of any desired configuration of individual air injector nozzles that can be applied as a complete unit to a tub or spa. One or more of the arrays can be cut across the common air flow tube to achieve the exact number of individual nozzles required in accordance with the desired arrangement of air injector nozzles. The arrays, including the cut arrays can be joined together at a location other than at the tub or spa and then transferred as a complete unit to be attached to the tub or spa. The plurality of arrays can be joined by a straight or angled connector fitting that can comprise a separate connector fitting or an individual air injector nozzle having air flow tubes arranged in the straight or angled configuration.

11 Claims, 7 Drawing Sheets

AIR INJECTOR SYSTEM APPARATUS AND METHODS FOR A TUB OR SPA

CROSS REFERENCE TO RELATED APPLICATIONS

This application is related to my co-pending patent application Ser. No. 10/994,884, filed on Nov. 22, 2004, entitled "Air Injector Nozzle Apparatus and Methods for a Tub or a Spa."

BACKGROUND OF THE INVENTION

1. Field of the Invention

This invention is related in general to the field of air injector apparatus and particularly to the field air injector nozzles adapted to be applied to spas or bathtubs that include an air injection arrangement to inject pressurized air through jets or nozzles which are distributed over the interior of the tub or spa.

2. Description of the Prior Art

The prior art method and apparatus to construct a bathtub or spa having a plurality of air injection nozzles and associated tubing attached to and distributed about the underside of the tub is a very labor intensive and therefore costly procedure, (hereinafter the word "tub" will be used to identify a bathtub, spa, or any other water containment vessel that utilizes an air injection system).

The typical prior art procedure is to blow a thick layer of fiberglass and resin onto the underside of the tub. A plate having a plurality of pre-positioned holes distributed over the length and width of the plate is placed on the laid layer of fiberglass. A second thick layer of fiberglass and resin is then applied to the tub including the plate positioned thereon. The holes in the plate create depressions in the second layer of fiberglass. The tub is inverted and a second plate having a plurality of holes is positioned inside the tub; a marking instrument is inserted in the holes to mark the hole location on the inside of the tub and the second plate is removed. The markings from the holes in the second plate are aligned with the depressions created by the holes in the first plate. Holes are drilled through the tub at the hole markings. The tub is again inverted. The depressions on the bottom of the tub are then machined flat in preparation for the later attachment of the individual injector nozzles.

One prior art injector nozzle comprises a circular plate having a small diameter tube extending from one side of the plate and a separate threaded connector. With this type of prior art nozzle, the small diameter tube is inserted into the hole in the tub with the circular plate being fitted against the machined depressions on the bottom of the tub. Another type of prior art injector nozzle does not include the small diameter tube, but includes the separate threaded connector. The air from this type of nozzle exits at the connection of the attaching plate and passes through the hole in the tub. With either type of prior art nozzle, a liquid silicon rubber is then used cover the circular plate and fills the depression. Then, the separate connector member having a threaded end and a hose connection end is threaded onto the nozzle. Plastic hoses are connected to the hose connections joining the all of the nozzles and then to a manifold to which a high-pressure air connection is later made when the tub is installed. The portions of the small diameter tube of the nozzles, if this type is used, are then cut flush with the interior of the tub.

The construction and design of the prior art nozzles and connector members largely contribute to the costly and labor-intensive prior art procedure above described.

In my prior patent application, above referenced, I have shown and described various embodiments of individual air injector nozzles that can be connected to each other or to interconnecting tubing. While the inventive features of that application have substantially reduced the prior art time, effort, and costs associated with installing an arrangement of air injector nozzles to a tub, there still exists some structural limitations that if improved, can even further reduce the labor and costs.

Accordingly, what is needed is a nozzle system that even further minimizes the labor involved in adapting an air injection arrangement to a tub as well as providing an improved injector nozzle assembly. The primary objects of the present invention accomplish and fulfill these needs.

The above-stated object as well as other objects which, although not specifically stated, but are intended to be included within the scope of the present invention, are accomplished by the present invention and will become apparent from the hereinafter set forth Detailed Description of the Invention, Drawings, and the Claims appended herewith.

SUMMARY OF THE INVENTION

The present invention accomplishes the above-stated objective as well as others, as may be determined by a fair reading and interpretation of the entire specification herein. The present invention comprises an integral array of a plurality of air injector nozzles connected to a common air flow communication member. Each individual nozzle comprising a combination including an air flow tube, an air injector flow tube, and an attaching member. The air flow tube of each air injector nozzle in practice comprises a portion of the air flow communication member. The array of injector nozzles provides for correct alignment between individual nozzles when attached to a tub. Provides for even distribution of the individual nozzles on the tub. Provides a means for selectively configuring the proper number of nozzles regardless of the size of the tub and the desired arrangement of the nozzles on the tub. Provides for utilizing an individual or a plurality of nozzles at any location on the tub. Provides for the incorporation of the individual nozzles disclosed in my prior application to the inventive array. Provides for extreme flexibility in the design of the system arrangement for a tub. And, allows for bench assembly of the entire nozzle arrangement and the subsequent attachment of the nozzle assembly to a tub. Other advantages will be apparent in accordance with the below detailed description of the invention.

The attaching member of each individual nozzle in the array of nozzles is adapted to be directly attachable to as laid fiberglass, cured or uncured, on the outside bottom of a tub with the assurance that the attaching plate of each air injector nozzle is firmly and sealingly seated against the tub bottom. The inventive nozzle array provides the means to drill holes through the tub at the exact location of the nozzles without having to use a standard or particular layout of the nozzles.

The inventive method provides for connecting one nozzle array to another array or to an individual air nozzle using a fitting, a telescoping arrangement, or a combination of both. The inventive method and apparatus allows for extreme versatility in designing a nozzle arrangement and making any last minute changes. The inventive method and apparatus simplifies the entire process of fitting a tub with an air injection arrangement and significantly decreases the labor, time and costs associated with fitting a tub with an air injection arrangement.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 2:
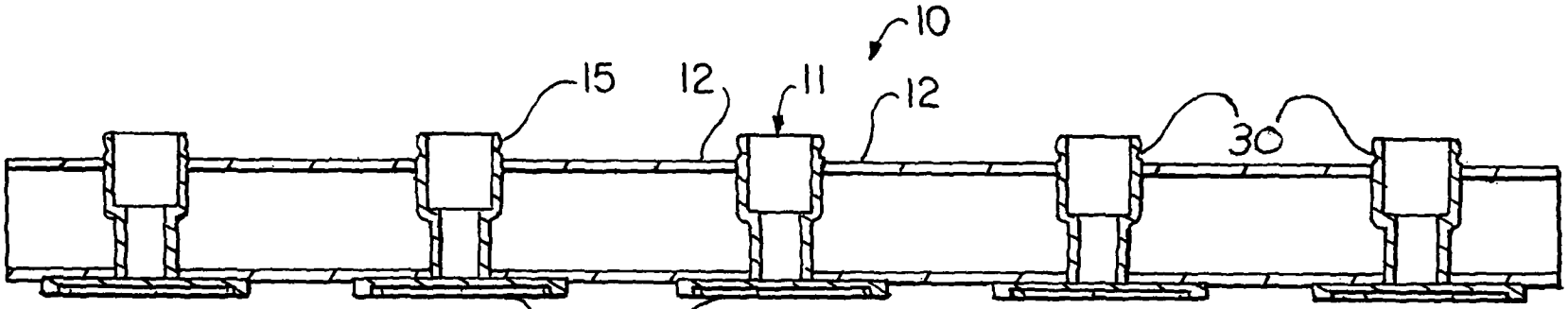
FIG. 2 is a cross sectional of the embodiment of FIG. 1 taken through the line 2-2 thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

Reference is now made to the drawings, wherein like characteristics and features of the present invention shown in the various figures are designated by the same reference numerals where however, the scale of each drawing may or may not be the same.

Figure 1:
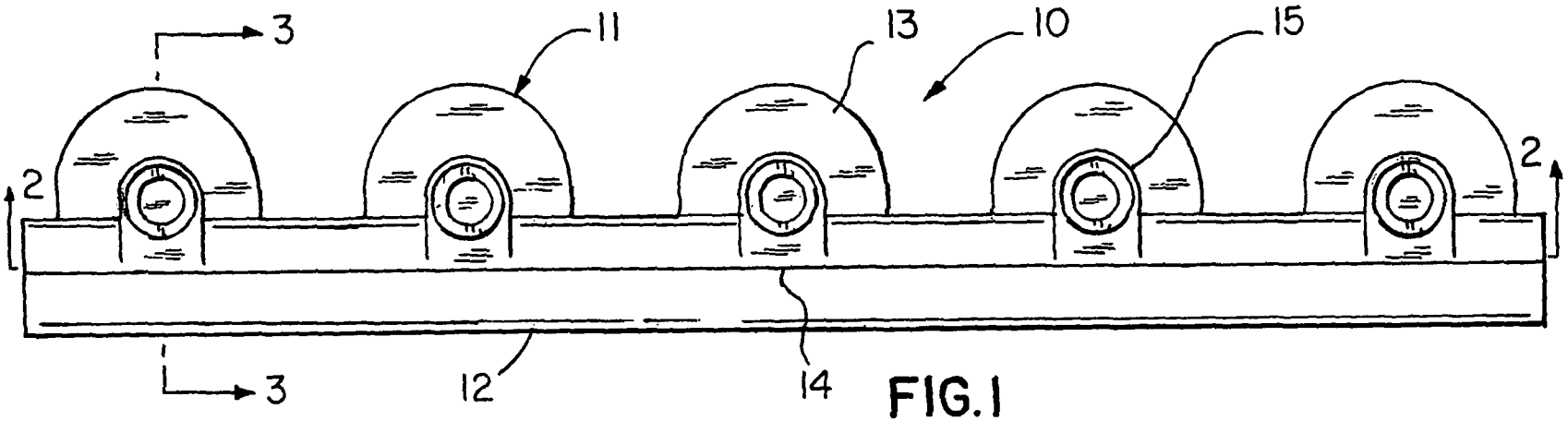
FIG. 1 illustrates is a top view of one embodiment of the inventive nozzle array.

Reference is now made to FIGS. 1 and 2 which are a top view, and a cross sectional side view respectively, of one embodiment of an array 10 of air injector nozzles 11 according to the present invention. As is shown, a plurality individual air injector nozzles 11 are attached to each other by a common air flow communication member 12 with the individual air injector nozzle being substantially equally spaced along the length of the common air flow communication member 12. In the illustrated embodiment, an array 10 of five air injector nozzles 11 are shown; however, more or less air injector nozzles 11 may be included in the array 10 of air injector nozzles 11. The spacing between the individual air injector nozzles 11 can be of any convenient or desired distance. However, a sufficient length of the air flow communication member 12 should be provided between adjacent air injector nozzles 11 so that when an array 10 is cut between adjacent air injector nozzles 11 for the purpose more fully explained below, a sufficient length of the air flow communication member 12 extends beyond each end of nozzles 11 at the cut. The sufficient length of the air flow communication member 12 extending beyond each end of nozzles 11 at the cut, allows for a proper joint with another array 10 or a direction changing fitting or nozzle. Moreover, the spacing of the individual air injector nozzles 11 along the array 10 of air injector nozzles 11 can be equidistant, but the invention is not limited to the individual air injector nozzles 11 being equidistantly spaced. Similarly, the array 10 of air injector nozzles 11 in a preferred embodiment are in a substantially straight line, but the invention is not to be so limited. Further, although the individual air injector nozzles are shown to be oriented on one side of the air flow communication member 12, the invention includes the orientation of individual nozzles 11 on either or both sides of the air flow communication member 12. For convenience, the size of the air flow communication member 12 can be that of standard, commercially available, PVC tubing. A molded line 14 is provided at the top center of the air flow communication member 12 so that proper alignment of the attachment of one array 10 to another array 10 can be visually ascertained.

The basic elements of an air injector nozzle 11 include a base or attaching plate 13, a portion of the air flow communication member 12 and an air injection tube 15. The portion of the air flow communication member 12 may be considered to be an air flow tube of a nozzle 11 that extends in two outward directions from the air injection tube 15. Thus, a portion of the air flow communication member 12 also extends an appropriate distance from each end of the array 10. The internal diameter of the air flow communication member 12 is appropriately sized to permit a sufficient volume of airflow through an assembly of connected arrays 10 connected in series or parallel, as is well known in the art.

Figure 3:
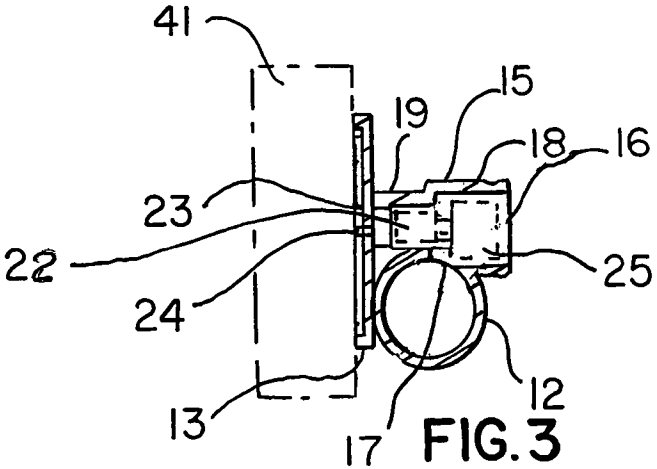
FIG. 3 is a cross sectional view of the embodiment of FIG. 2 taken along the line 3-3 of FIG. 2.

Specific details of the injector tube 15 and the attaching plate 13 of the individual air injector nozzles 11 will now be described particularly with additional reference to FIG. 3. Inasmuch as the inventive array 10 of air injector nozzles 11 is specially configured to be able to be cast or molded in one piece, the air injection tube 15, the air flow communication member 12 and the attaching plate 13 are integrally connected to each other. The air injection tube 15 includes an internal opening 16 that is positioned substantially perpendicular to the central axis of the air flow communication member 12 and to the plane of the attaching plate 13. As seen in FIG. 3 the injector tube 15 is located in perpendicular alignment with but spaced from the central axis of the main flow tube 12 such that the opening 16 within the air injector tube 15 intersects with the internal diameter of the air flow communication member 12. In this manner, a flow communication opening 17 is created between the air flow communication member 12 and the injector tube 15. That is, that the opening 16 within the air injector tube 15 is in flow communication with the internal diameter of the air flow communication member 12 so as to allow flow communication of air from air flow communication member 12 into the air injection tube opening 16.

The intersecting relationship of the air flow communication member 12 with the air injector tube 15 is seen in cross section FIG. 3. Here it is seen that the air injector opening 16 within the air injector tube 15 includes a first larger diameter portion 18 and a smaller second diameter portion 19. An annular groove 30 is provided within the first larger diameter portion 18 of the air injector tube opening 16 a small distance down from the top edge 21 of the air injector tube 15. As explained further herein, the groove 17 is used in conjunction with a sealing plug.

In a simpler embodiment, the air injector tube 15 and opening 16 can comprise a single external and internal diameter tube that is not shown but can be readily envisioned and is intended to be included within the scope of the present invention. However, the two-diameter air injection tube 15 is preferred and is advantageous for a number of reasons.

A prior art check valve 22, shown in phantom in FIG. 3, is commonly used with each of the nozzles 11 of an air injection arrangement so as to prevent water that is located in the tub from backing up into the airflow channels. The smaller diameter portion 19 of the air injector tube 15 is sized to accommodate the commonly used check valve. The larger diameter portion 18 is sized so as to create the flow communication opening 17 between the air flow communication member 12 and the air injection tube 15. The smaller diameter portion 19 does not necessarily form part of the flow communication opening 17; however the smaller diameter portion 19 is in flow communication with the air flow communication member 12 via the flow communication opening 17. This unique configuration also allows the array 10 of air injector nozzles 11 to be molded in one piece while providing the means to accurately drill a hole in the tub at the exact location of each of the air injector nozzles 11 without the extra effort and jigs required in the prior art.

In the preferred embodiment, the smaller diameter portion 19 of the air injector tube 15 is closed at the bottom end 23 preferably before the nozzle arrangement in its entirety is applied to the tub. The closed bottom end 23 forms part of the attaching plate 13, the advantage of which is more fully explained hereinafter.

The air injector tube 15 of the inventive array 10 of air injector nozzles 11 being uniquely positioned to the outside of the outer diameter of the air flow communication member 12 serves a number of advantages. Except for the necessary flow communication opening 17, the integrity of the air flow communication member 12 is not compromised. But primarily, it provides a means drill a hole 24 simultaneously through the closed bottom 23 of the injector tube 15 and through the tub at the exact same location. No jigs or fixtures are required as in the prior art to align the holes in the tub with the nozzle holes. Since the nozzle holes and the holes in the tub are drilled at the same time the two holes are automatically in alignment.

In practice, the simultaneously drilling of the hole 24 in the closed bottom end 23 of the injector tube 15 and through the tub 41 (shown in phantom in FIG. 3) can readily be accomplished by various prior art techniques. For example a stepped drill can be used to guide the drilling by using the opening in the smaller diameter portion 19 in the injector tube 15 as the guiding surface. The stepped drill having two diameters, one diameter comprising the drill portion having the size of the hole to be drilled through the closed end bottom end 23 of the nozzle 11 and through the tub 41, the other diameter being larger and having the size of the opening in the smaller tube portion 19. The larger diameter portion of the two stepped drill can comprise a circular cylinder without drilling flutes so as to only be guided within the opening of the smaller tube portion 19 and not cause any drilling of the opening in the smaller tube portion 19. Another technique can use a jig having an outer diameter sized to fit within the smaller diameter portion 19 with an opening there through sized to accept and guide a drill bit having the diameter of the hole 24 to be drilled. In this manner, the air injection hole 24 through the closed bottom 23 and through the tub 41 can be drilled at the exact location of the opening in the air injector tube 15 when the array of air injector nozzles 10 are affixed to the tub. This completely eliminates the prior art method of having to locate the air injection holes in the tub by using the aforedescribed plate on the tub's underside and the jig plate inside the tub. Moreover, the inventive array 10 of air injector nozzles 11 completely eliminates the need for the prior art air nozzle configuration having an injector tube extending through the tub and the necessarily larger diameter hole in the tub to accommodate the outside diameter of the prior art injection tube, as well as the need to seal between the prior art injection tube and the hole in the tub.

In another embodiment but somewhat less preferred, the hole 24 is provided in bottom end of the air injector tube 15 before the array 10 of air injector nozzles 11 is attached to the bottom of the tub This can be accomplished during the casting or molding process in making the array 10, or can be drilled thereafter. This enables the hole 24 to be used to guide a drill bit of the same diameter through the tub and again at the exact location of the individual nozzles 11. However, it is not good practice to use an existing hole as a guide because of the possibility of the drill bit damaging the original hole in the nozzle.

Figure 3A:
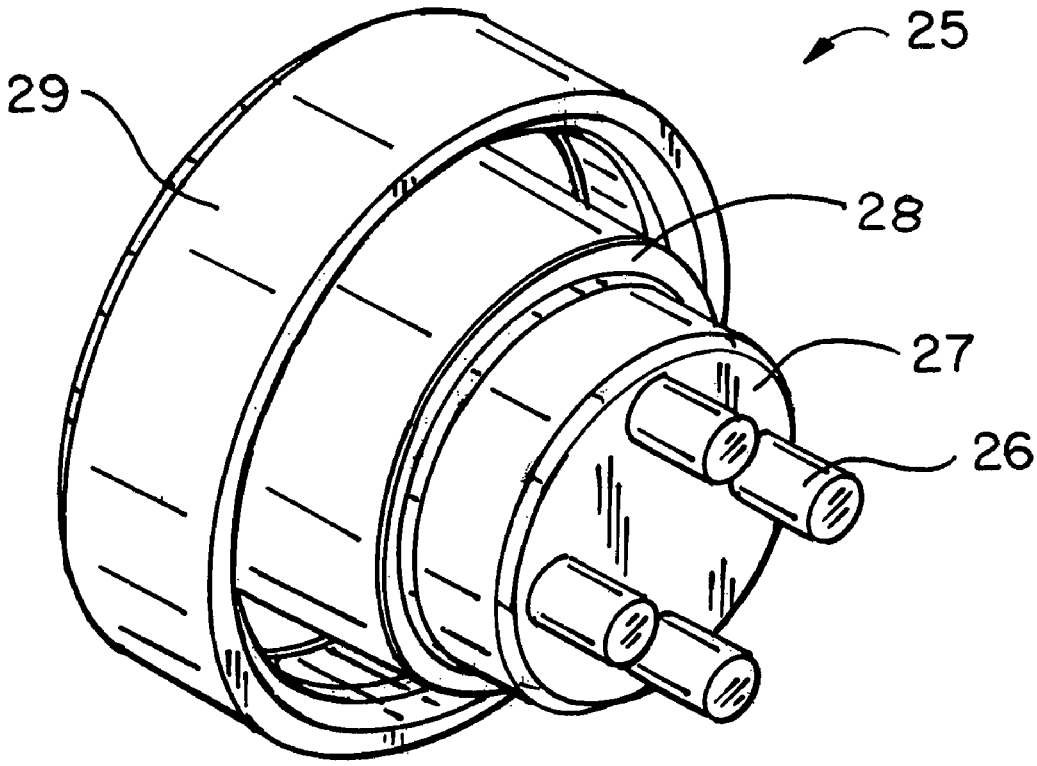
FIG. 3A is an illustration of a plug for sealing individual nozzles and maintaining a check valve in position.

The air communication opening or channel 17 permits the flow of air through the air flow communication member 12 to be directed into and through the air injection opening 16, through the check valve 22 located within the smaller diameter portion 19 of the air injector tube 15, and eventually into the tub. During attachment of the arrays 10 to the tub, a throw away cap can be fitted over or into the opening 16 in the injector tube 15 so as to prevent fiberglass from entering the injector tube opening 16. After the arrays 10 are permanently attached to a tub and no further fiberglass is to be applied, the throw away cap is removed and discarded and a permanent cap or plug 25 is used to seal the open end of the air injector tube 15. The sealing plug 25 is shown in FIG. 3A. Sealing plug 25 actually serves two important purposes. It seals the opening 16 and thus functions to prevent the flow of air within the air injector arrangement applied to a tub from escaping to the atmosphere. It also serves to fix the position of the check valve 22 within the smaller diameter portion 19 and yet permit the flow of air through the flow communication opening 17 to enter and flow through the check valve 22 into the tub. This double function of the sealing plug 25 is accomplished by one or more prongs 26 extending downward from the bottom end 27 of plug 25. The bottom end 27 of plug 25 is dimensioned relative to a step 28 on the body of the plug 25 such that the step 28 rests against the top edge 21 of the injector tube 15 when the plug 25 is inserted into the opening 16 in the injector tube 15. The prong or prongs 26 are dimensioned to rest against the top of the check valve 22 when the step 28 is in contact with the top edge 21 of the injector tube 15. The open space between the prongs 26 serves to allow air flow from the flow communication opening 17 into and through the check valve 22. Any equivalent structure in lieu of a prong or prongs 26 can be used. For example, the bottom end 27 of plug can be extended to the end location of the prongs 26 and cross slotted or even drilled to form the open spaces. The cover portion 29 of plug 25 serves to seal down and around the external diameter of the larger diameter portion 18 of the injector tube 15. An O ring internal to the cover forms an effective seal.

Figure 4:
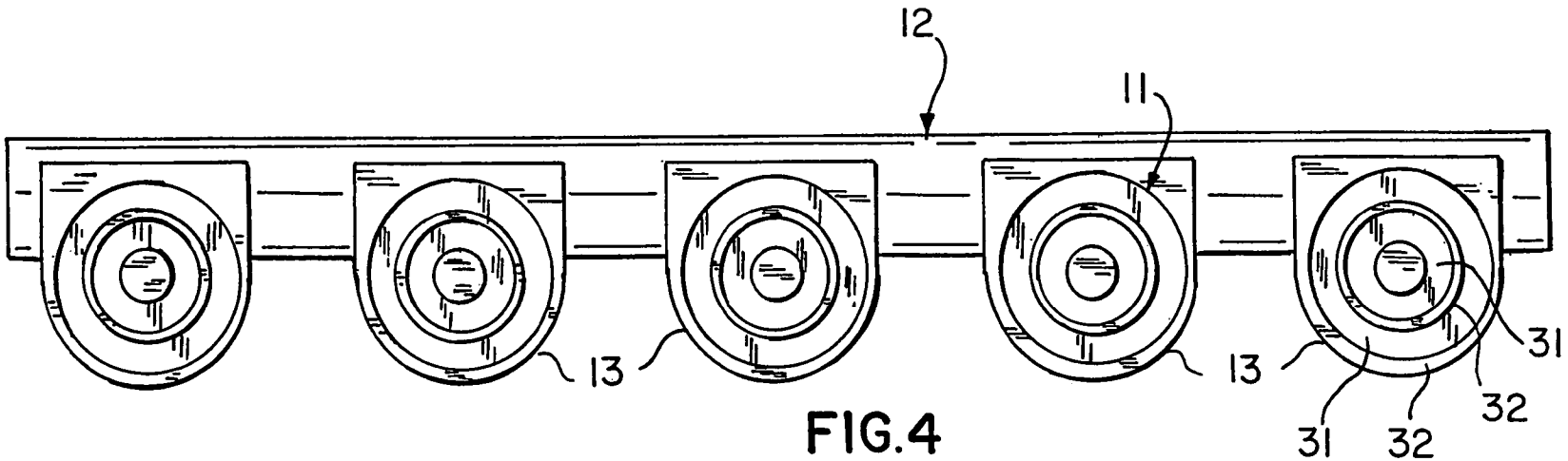
FIG. 4 is an underside view of the nozzle array embodiment of FIG. 2.

FIG. 4 illustrates one embodiment of the underside of the array attaching plates 13. In this embodiment, one or more concentric grooves 31, with ridges 32 therebetween are provided at the bottom surface of the attaching plate 13. The grooves 31 and ridges 32 allow for direct application of the attaching plate 13 to the fiberglass of the tub before the fiberglass is cured such that the attaching plate 13 is capable of being inserted into the semi-liquid state of the uncured fiberglass. The ridges and grooves, 31, 32 will accordingly form corresponding ridges and grooves in the uncured fiberglass forming an effective seal. Once the fiberglass is cured, a leak proof and firm connection is effectuated between the tub and the array 10 of air injector nozzles 11. In this manner, the inventive array 10 of air injector nozzles 11 saves the time of having to wait for the fiberglass to fully cure as required by the prior art and the labor and effort to machine the flat surfaces on the cured fiberglass as done in the prior art. If, however, it is desired to attach an array 10 of air injector nozzles 11 to the tub after the fiberglass has cured, the inventive array 10 of air injector nozzles 11 does not require the machining of the flat spots as in the prior art. By providing the grooves 31 and the ridges 32, or the equivalent thereof, the inventive array 10 of air injector nozzles 11 can be directly applied to the as laid and cured fiberglass. The grooves 31 allow for easy application of a generous bead of silicone rubber in each of the grooves 31 forming the leak proof and firm attachment to the tub.

Prototype testing has shown that the array 10 of air injector nozzles 11 can accommodate relatively uneven as laid fiberglass when a generous amount of silicon rubber is applied to the grooves 31 of the attaching plates 13, and the array 10 of air injector nozzles 11 is directly applied to the as laid and cured fiberglass on the underside of the tub. The molded in lines 14 along the length of air flow communication member 12 at its upper surface permit the attachment of a plurality of arrays 10 to each other with each of the attaching plates being substantially co-plainer and flat against the bottom of the tub. The concentric grooves and ridges also allow for a visual confirmation that sufficient silicon has been applied to the attaching plates 13 by evidence of excess silicon seeping out and around the attaching plates 13 when pressed against the cured fiberglass of the tub. It is to be noted however, that an attaching plates 13 having a flat underside surface as well as equivalent configurations other than grooves and ridges are contemplated to be included within the scope of the invention.

Figure 5:
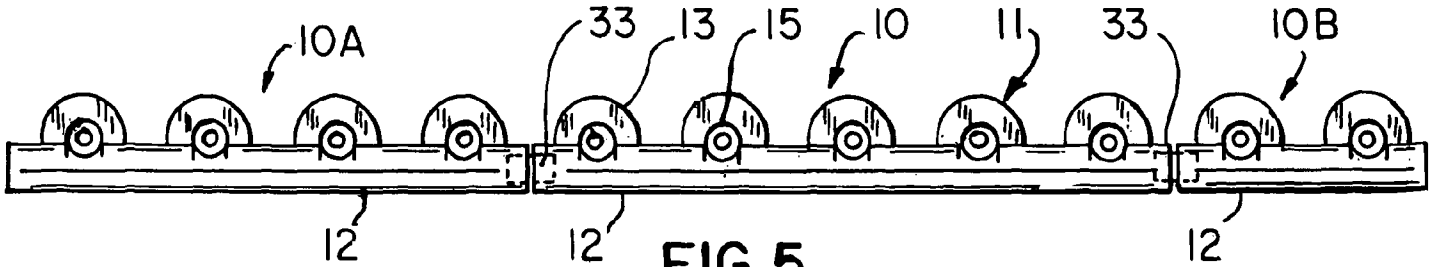
FIG. 5 is a top view of a connection of one array of five air injector nozzles to another array of four air injector nozzles, and to another array of two air injector nozzles.
Figure 6:
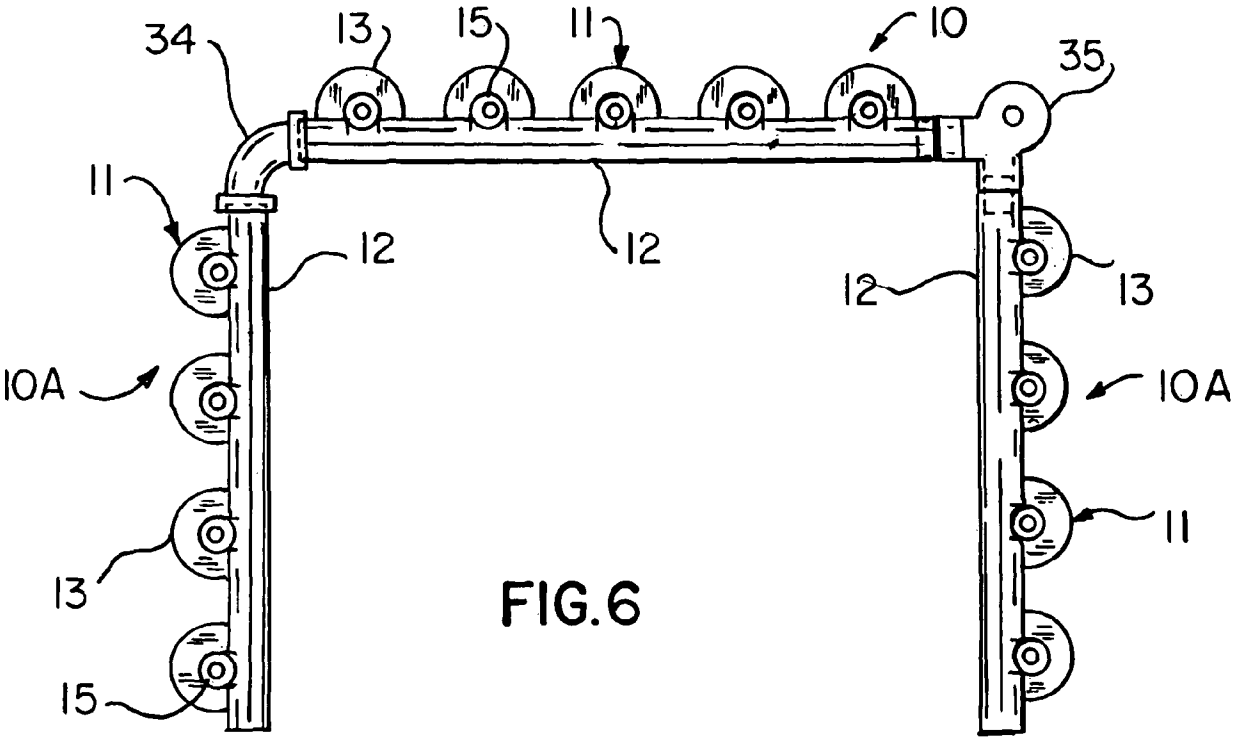
FIG. 6 is a top view of three arrays of five air injector nozzles connected at right angles to each other using different right angle connectors.

FIG. 5 illustrates an array 10 of five air injector nozzles 11 attached to an array 10A of four air injector nozzles 11 and to an array of two air injector nozzles 10B in a straight line to each other. The arrays 10A and 10B are obtained by cutting the air flow communication member 12 of an array 10 of, for example, an array of five air injector nozzles 11 at the approximate center location between the appropriate individual air injector nozzles 11 to result in the desired number of individual nozzles 11. The arrays 10, 10A and 10B can be connected to each other by an internal connector member 33. The connector member 33 and other types of connections that may alternatively be used to connect the arrays are described hereinafter FIG. 6 illustrates the versatility of the inventive nozzle array 10 to form a "U" shaped configuration of a plurality of individual air injector nozzles 11. As shown, an array 10A of four air injector nozzles 11 is connected at a right angle to an array 10 of five air injector nozzles 11, which in turn is connected at a right angle to another array 10A of four individual air injector nozzles 11. In one corner, a typical right angle PVC elbow 34 is used to connect arrays 10A and 10 to each other. In the other corner, an individual right angled air injector nozzle 35 as shown and described in my aforementioned patent application is used to attach array 10 to the other 10A array. The purpose of the same is to illustrate the ability to change the direction of an air flow arrangement as applied to a tub.

Figure 7:
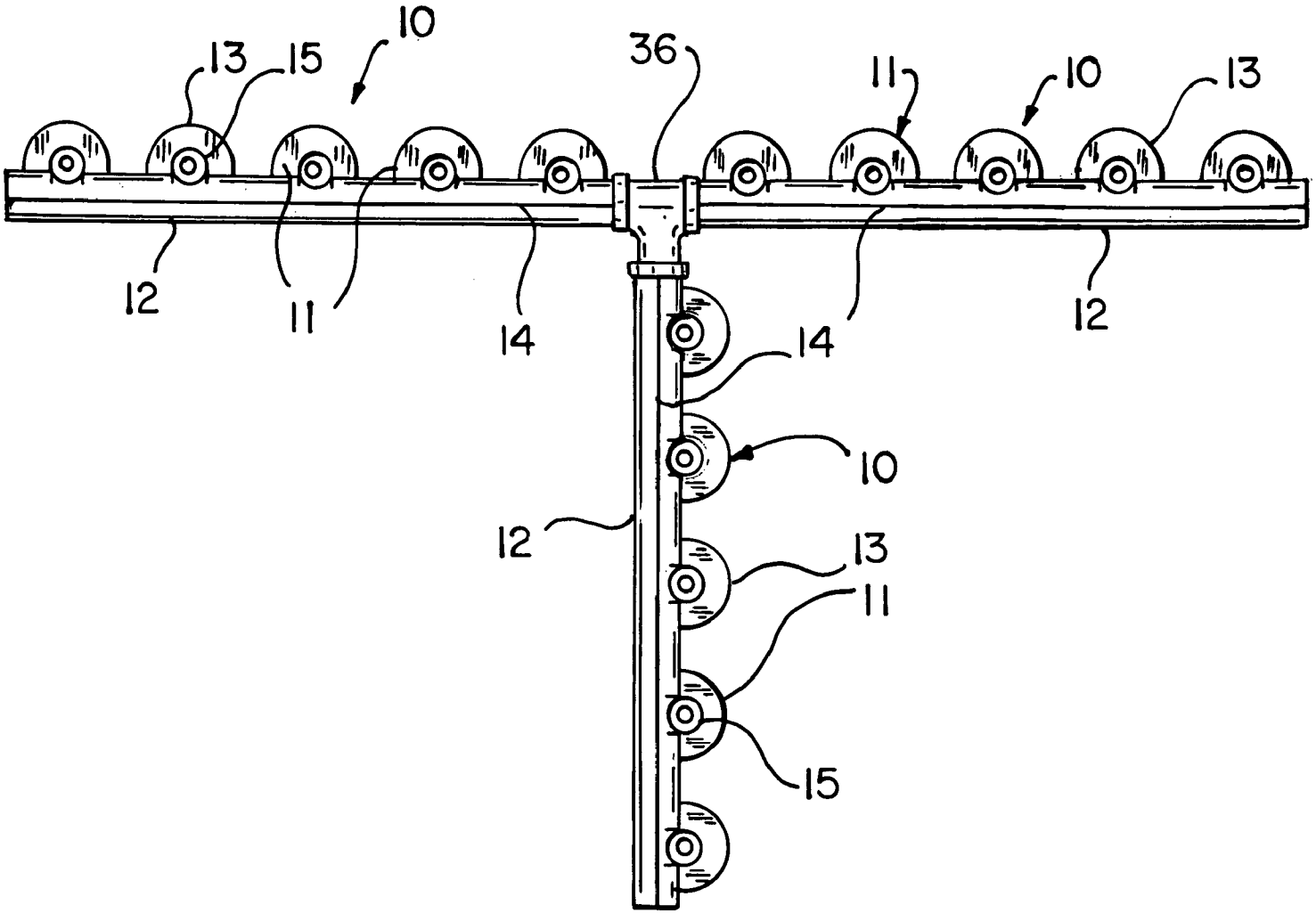
FIG. 7 is a top view illustrating the connection of three arrays of five air injector nozzles connected to each other in a "T" arrangement.

FIG. 7 illustrates three arrays 10 of five air injector nozzles 11 connected to form a "T" shaped configuration of a plurality of individual air injector nozzles 11. In this figure, a typical "T" PVC connector 36 is used to make the connection of arrays 10. Alternatively, a "T" air injector nozzle, as shown and described in my aforementioned patent application is may used to effect the connection of arrays 10. If a "T" air injector nozzle is used, a connector member 33 can be used at each joint to connect the arrays 10.

The various configurations of arrays 10 shown in FIGS. 5-7, but with any number of individual nozzles 11, can be connected to each other to form any desired overall nozzle arrangement to be attached to a tub. And, in accordance with FIGS. 5-7 it is seen that the inventive array 10 of air injector nozzles 11 eliminates the need to stock and join a large number of individual air injector nozzles in order to create any desired arrangement of air injector nozzles to be applied to a tub. Moreover, the inventive array 10 of air injector nozzles 11 eliminates the need to use a substantial amount of individual pieces of interconnecting tubing or fittings to join a plurality of air injector nozzles 11, and since fewer joints are involved, leakage problems are minimized. Even further, the inventive array of air injector nozzles 10 has been shown to complement the use of the various embodiments of air injector nozzles shown and described in my aforementioned patent application in creating a desired arrangement of air injector nozzles as applied to any tub.

Figure 8:
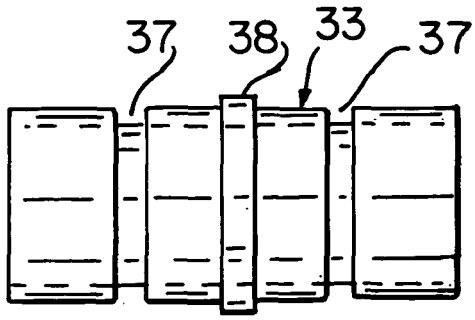
FIG. 8 is a side elevation view of a fitting for connecting adjacent arrays of air injector nozzles.

FIGS. 8-11 illustrate a number of various methods that can be used to join the inventive arrays 10 of air injector nozzles 11 shown in FIGS. 5-7. FIG. 8 illustrates a configuration of a connection fitting 33 that can be used to sealingly join straight ended tubing, such as that existing between cut or uncut arrays 10. The connection fitting 33 comprises a short length of a hollow cylindrical member having a central flange 38 and an annular groove 37 on either side of the flange 38. In practice the length of the connection fitting 33 can be of the order of approximately one to two inches with a spacing of the grooves 37 from the flange 38 approximately of the order of one quarter to one half of an inch. The grooves 37 serve the purpose of fitting an O ring therewithin. The outside diameter of the connection fitting 33 is sized to be slightly smaller than the inside diameter of the air flow communication member 12 so that it can slip into the flow tube 12 with relative ease, but such that the O ring forms a good seal.

Figure 9:
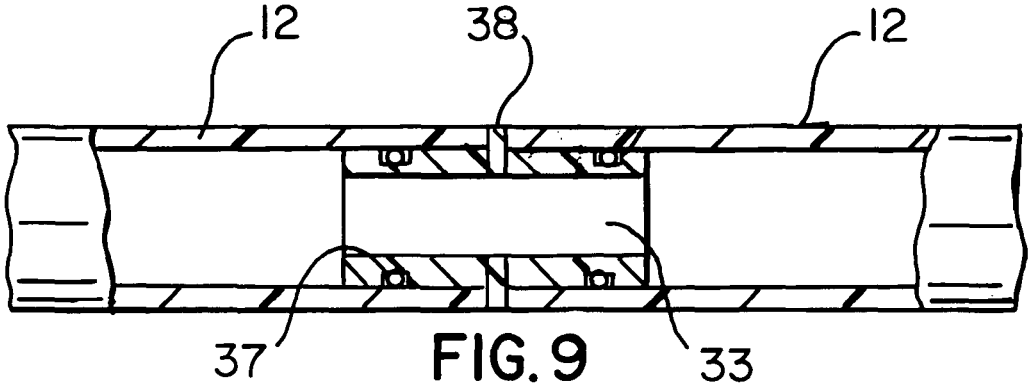
FIG. 9 is a cross sectional view illustrating the use of the connecting fitting of FIG. 8.

A typical connection using the connection fitting 33 is shown in FIG. 9. The advantage of the flange 38 is seen to precisely provide for half of the connector fitting 33 to be fitted within each straight end of the air flow communication member 12 of connected arrays 10. In FIG. 9, O rings are installed in grooves 37 to make a leak proof joint. While the flange 38 assures that the connecting member 33 is equally inserted in each straight end of the air flow communication member 12, the connector fitting 33 can satisfactorily function without the flange 38 by ordinary care being taken by an ordinary mechanic as to the depth of insertion of the connector member 33 in each end. The connector member 33 allows for complete sealing by the use of O rings and yet allows for some flexibility in the joint that may be necessary for alignment purposes when fitting an assembly of arrays 10 to a tub. Of course, if a non-flexible joint is desired, PVC cement or other appropriate adhesive can be applied to the connector fitting 33 before it is inserted in the ends of the arrays 10 to be joined. Also, a typical PVC male/male or female/female coupling member can be used to join the inventive array 10 to another array 10.

The connector fitting 33, shown to be configured to fit inside the connected flow communication members 12, is preferred; however, it can also be configured to fit the outside of the air flow communication member 12. In the latter embodiment, the O rings would be located either in grooves on the outside of the air flow communication member 12 or in grooves on the inside of the connector fitting 33 and the flange 38 would be located within the inside diameter thereof. If desired, a plurality of O rings can be used on either side of the connecting fitting 33.

Figure 10:
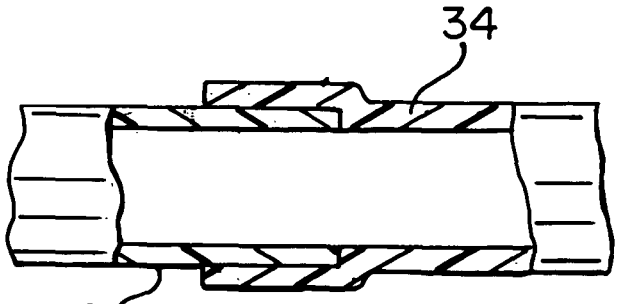
FIG. 10 is a cross sectional view illustrating a connection with an end of an array of air injector nozzles of FIG. 1 to a typical female end of PVC tubing.

FIG. 10 illustrates the joinder of a straight end of an air flow communication member 12 to an expanded or female end such as that used with a female ended PVC fitting. As seen, it is a simple joinder where the straight end extends within the expanded end an appropriate distance so as to effectuate a sealed joint when an appropriate adhesive or PVC cement is used.

Figure 11:
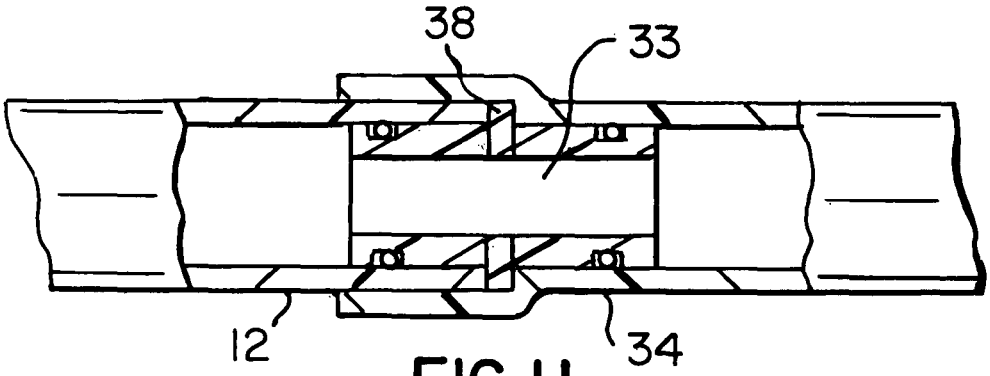
FIG. 11 is a cross sectional view illustrating the use of the connecting fitting of FIG. 8 as applied to a typical male-female connection of PVC tubing.

FIG. 11 illustrates an alternate method of joining a straight end of an air flow communication member 12 to an expanded or female end of a typical PVC fitting, together with the use of the interconnecting fitting 33. One half of the connecting fitting 33, with the O ring inserted in groove 37, is inserted into the straight end to the point where the flange 38 prevents further insertion. PVC cement or other appropriate adhesive is then applied either to the outer diameter of the straight end or the inside of the expanded end. The straight end having the connector fitting already inserted is then inserted into the expanded end until the flange 38 prevents further insertion.

FIGS. 8-11, in accordance with the above description, illustrate the ability of the inventive array 10 to be joined to each other, to a PVC tube, to a PVC fitting or to any individual air injector nozzle shown and describe in my afore mentioned patent application, using an effective and simple connector fitting 33, or its equivalent, or by using typical and known methods of joinder of PVC members.

Figure 12:
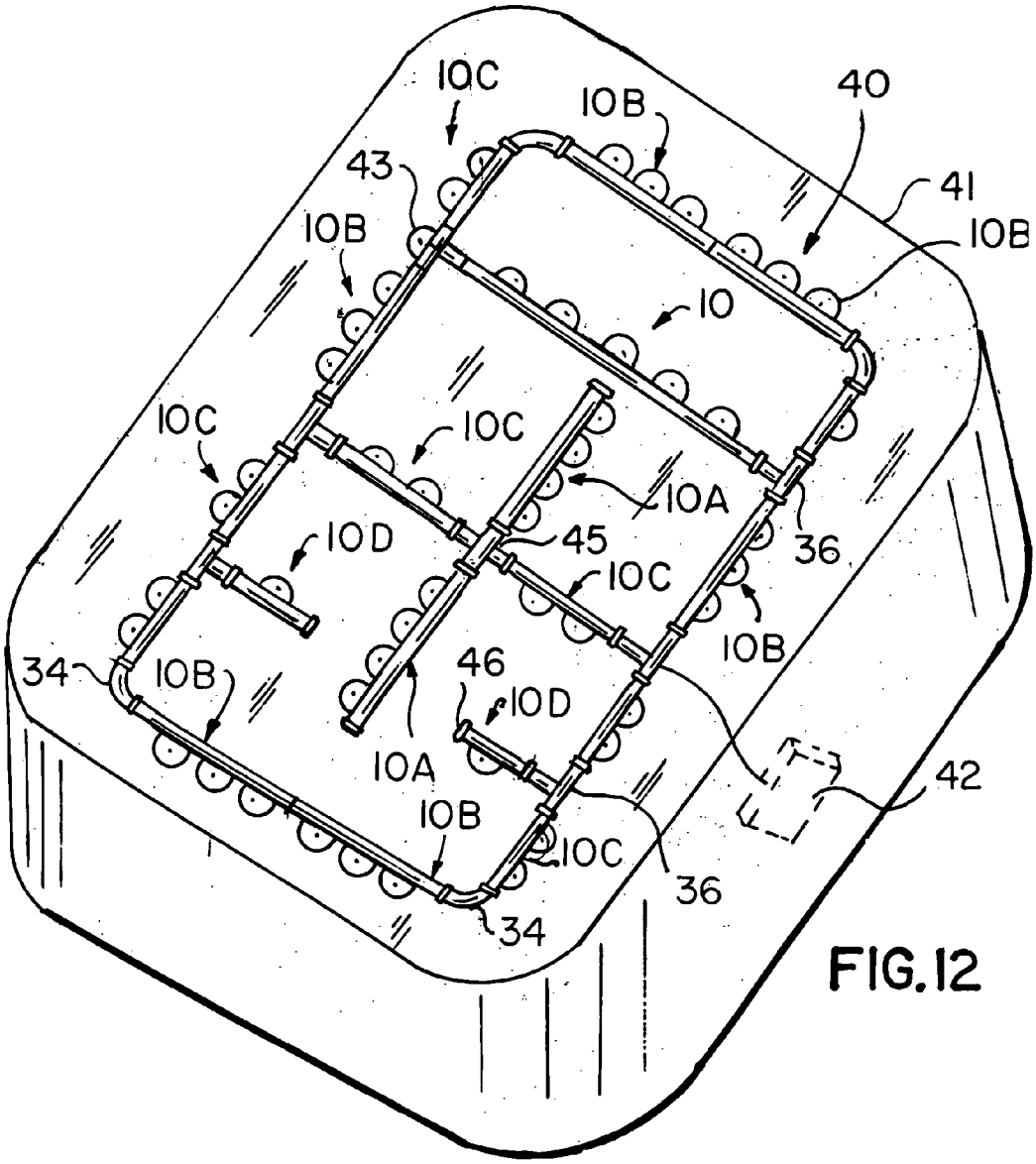
FIG. 12 is a schematic rendering of an arbitrary arrangement of air injector nozzles; attached to the bottom of a tub as the inventive arrays of air injector nozzles might be used in practice.

In practicing the invention, the following method is one that can be used to create a nozzle arrangement 40 to be attached to a tub 41, schematically shown in FIG. 12, using the inventive array 10 of air injector nozzles 11. For purposes of the following installation procedure using the invention described herein, it is assumed that a fabricator has a tub 41 to which he intends to install an air injection system. He will also have an air pump 42 and the associated equipment and tubing, an appropriate adhesive, fiberglass applying equipment, the proper type of fiberglass and resin, etc, all of which is available in the prior art. The fabricator will also have the layout or arrangement 40 of where the air injection nozzle arrays 10 are to be placed on the tub. To be noted is that the nozzle arrangement 40 shown in FIG. 12 is for purposes of illustration only and is not to be considered as a limitation of the invention. This also applies to the arrangements shown in FIGS. 5, 6, and 7.

In accordance with the arrangement 40 shown in FIG. 12, the fabricator selects a plurality of arrays 10 of five air injector nozzles 11 as in the embodiment of FIG. 1. The fabricator cuts some of the arrays 10 of the five individual nozzles such that the number of nozzle arrays 10 and individual nozzles 11 are obtained in accordance with the arrangement in FIG. 12. In FIG. 12 an array of five nozzles is designated as 10, four nozzles 10A, three nozzles 10B, two nozzles 10C, and one nozzle 10D. Where 90 degree bends are called for, common 90 degree PVC elbows 34 can be used or a right angle individual air injector nozzle 35 can be used are used; where "T" connections are called for, common "T" PVC fittings 36 can be used or an individual "T" air injector nozzle 43 can be used are used; where a "cross" fitting is called for, a common PVC cross fitting 45 can be used; and, where an end of an array of nozzles 10 is not connected to another array of nozzles 10, a common PVC end cap 46 can be used to seal such unconnected end. Inasmuch as the common PVC fittings generally have female ends, the joinder shown in FIG. 10 or 11, can be utilized. Where the arrays 10 are to be joined to each other in a straight line a common PVC coupling member or the preferred connector member 33 can be used as shown in FIG. 9. The use of the connector member 33 is the preferred method to attach the components of the arrangement 40 because of the ability to twist and turn the individual components so that the attaching plates 13 of the nozzles 11 lie firmly against the bottom of the tub 41. Also, the use of the connector members 33 allows for simple correction of any errors made by the fabricator or any last minute changes to the arrangement 40.

The fabricator lays out the PVC fittings, the connector fittings 33, any necessary PVC tubing, any necessary individual air injector nozzles, any necessary end caps, and the appropriate number of arrays 10, 10A, 10B, 10C, and 10D, on a bench or other appropriate surface. The fabricator arranges each nozzle array at the location according to the planned layout in FIG. 12. Should it be necessary to provide additional space between adjacent individual nozzles 11, a length of common PVC tubing can be used along with two tubular sleeve connectors 33. Any such needed connecting tubing is cut to length and laid out where it will be used.

At this point, the physical components will be laid out and arranged to duplicate the planned arrangement. For purposes of this description, the arbitrary layout 40 such as that shown in FIG. 12 is assumed to be the layout that the fabricator intends to install on the tub. It being understood that the use of the inventive nozzles is not restricted to the layout of FIG. 12. The connection of the air pump 42 to the tub 41 or wherever it is located is as known in the prior art.

The fabricator then temporarily connects all of the members shown in FIG. 12 to make certain that the assembled arrangement is in accordance with the planned layout 40. The lines 14 molded onto the top center of each array 10 in the axial direction of the array 10 provides the fabricator with the ability to align each line with the line on adjacent arrays 10 or individual nozzles 11 to provide visual confirmation that the planes of all of the attaching plates 13 are in the same plane. After confirming that the laid out and temporarily connected members are correctly positioned and aligned, the fabricator begins to make the connections permanent as per the above, while making certain that each of the attaching plates 13 are flat against the work bench.

The underside of the tub 41 can now coated with its final layer of fiberglass as per the prior art or is coated during the time that the nozzle arrangement is being assembled. In practice, in the prior art, the final layer of fiberglass comprises a mixture of chopped strands of fiberglass and resin (the mixture being in a semi-liquid state) which is blown onto the tub 41. The fitted together arrangement shown in FIG. 12 is then moved from the bench and appropriately position on the still uncured layer of fiberglass on the bottom of the tub 41. Each array of nozzles 10 or individual nozzles 11 are then pushed into the uncured fiberglass making certain that attaching plate 13 of each nozzle 11 is firmly imbedded into the fiberglass such that when the fiberglass is cured, a leak free attachment exists. If necessary, each joint using the connector piece 33 is checked to make certain that the joints are properly connected as per FIG. 9.

After the fiberglass has fully cured and each nozzle in the arrangement is fixedly secured within and to the fiberglass, the air injection holes 24 are drilled through the bottom 23 of the air injector tube 15 and through the tub 41, as described above. A check valve 22 is fitted to the opening in the injector tube 15 of each nozzle 11, and an O ring is inserted in the groove at the outside top end of the injector tube 15. A sealing plug 25 having extending legs or prongs 26 is pushed onto each injector tube 15 thereby sealing the upper open end of each injector tube 15 and maintaining the position of the check valve 22 in place within the smaller diameter portion 19 of the injector tube 15. This completes the assembly.

The use of the inventive nozzle arrays is also not restricted to being applied to uncured fiberglass. For example the arrangement in FIG. 12 can be bench fabricated and laid out on the bottom of a tub using silicon rubber at the base of each attaching plate 13 to seal the nozzle arrays 10 to the tub. Then the air injection holes 24 and the holes in the tub are simultaneously drilled. The check valves 22 are inserted in the injector tubes 15 and the sealing plugs 25 are applied to the open end of the injector tubes as per the above procedure. A final layer of fiberglass can then be applied over the connected arrangement of nozzle arrays 10 further securing the attachment of the nozzle arrangement 40 to the bottom of the tub 41.

Another alternative to the above use of the inventive nozzle arrays 10 being applied to a first cured layer of fiberglass can comprise temporarily plugging or capping the open end of the injector tubes 15 with a throw-a-way plug or cap. Then the final layer of fiberglass is applied. After the fiberglass has cured the temporary caps or plugs are removed, the air injector holes 24 and the holes through the tub are simultaneously drilled, the check valves 22 installed and the permanent plugs 25 attached.

It is to be noted that the application of a final layer of fiberglass over the nozzle arrangement 40 attached to a first layer of cured or uncured fiberglass has the added advantage of insulating the air being injected into a tub. The final layer of fiberglass provides an insulating coating over the entire arrangement 40 of assembled and sealingly connected arrays of air injector nozzles attached to the tub. This added insulation acts to advantageously maintain the elevated temperature of the air as it flows through the system and into the tub 41.

As shown and described, there exist a number of installation procedures that can be effectively used with the inventive array 10 of air injector nozzles 11—any one of which substantially reduces the labor and the time involved in the labor as compared to the prior art and provides an improved nozzle arrangement.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. Nozzle apparatus adapted to be attached to a tub or spa for injection of air into the tub or spa, said nozzle apparatus comprising an array of air injector nozzles comprising an air flow communication member, and a plurality of air injector nozzles said air flow communication member integrally connecting adjacent air injector nozzles, said plurality of air injector nozzles being spaced from each other along said air flow communication member, said air flow communication member extending in a substantially straight line, each of said air injector nozzles including an integral air injector tube, an integral connector plate, and a flow communication channel between the air flow communication member and the air injector tube, said flow communication channel being formed by an intersection of an inner diameter of the air injector tube and an inner diameter of the air flow communication member, said air injector tube being open at a first end and closed at a second end, said closed end of the air injector tube forming a portion of said connector plate.

2. Nozzle apparatus adapted to be attached to a tub or spa for injection of air into the tub or spa, said nozzle apparatus comprising an array of air injector nozzles comprising an air flow communication member, and a plurality of air injector nozzles said air flow communication member integrally connecting adjacent air injector nozzles, said plurality of air injector nozzles being spaced from each other along said air flow communication member, said air flow communication member extending in a substantially straight line, each of said air injector nozzles including an integral air injector tube, an integral connector plate, and a flow communication channel between the air flow communication member and the air injector tube, said flow communication channel being formed by an intersection of an inner diameter of the air injector tube and an inner diameter of the air flow communication member, said air injector tube being open at a first end and closed at a second end, said closed end of the air injector tube forming a portion of said connector plate, an axial centerline of said air injector tube being spaced from an axial centerline of said air flow communication member.

3. Nozzle apparatus adapted to be attached to a tub or spa for injection of air into the tub or spa, said nozzle apparatus comprising an array of air injector nozzles comprising an air flow communication member, and a plurality of air injector nozzles said air flow communication member integrally connecting adjacent air injector nozzles, said plurality of air injector nozzles being spaced from each other along said air flow communication member, said air flow communication member extending in a substantially straight line, each of said air injector nozzles including an integral air injector tube, an integral connector plate, and a flow communication channel between the air flow communication member and the air injector tube, said flow communication channel being formed by an intersection of an inner diameter of the air injector tube and an inner diameter of the air flow communication member, said air injector tube being open at a first end and closed at a second end, said closed end of the air injector tube forming a portion of said connector plate and having an air injector hole in said closed end, an axial centerline of said air injector tube being spaced from an axial centerline of said air flow communication member.

4. Nozzle apparatus adapted to be attached to a tub or spa for injection of air into the tub or spa, said nozzle apparatus comprising an array of air injector nozzles comprising an air flow communication member, and a plurality of air injector nozzles said air flow communication member integrally connecting adjacent air injector nozzles, said plurality of air injector nozzles being spaced from each other along said air flow communication member, said air flow communication member extending in a substantially straight line, each of said air injector nozzles including an integral air injector tube, an integral connector plate, and a flow communication channel between the air flow communication member and the air injector tube, said flow communication channel being formed by an intersection of an inner diameter of the air injector tube and an inner diameter of the air flow communication member, said air injector tube being open at a first end and closed at a second end, said closed end of the air injector tube forming a portion of said connector plate and having an air injector hole in said closed end, a sealing member attached to said open end of said air injector tube, an axial centerline of said air injector tube being spaced from an axial centerline of said air flow communication member.

5. Nozzle apparatus adapted to be attached to a tub or spa for injection of air into the tub or spa, said nozzle apparatus comprising an array of air injector nozzles comprising an air flow communication member, and a plurality of air injector nozzles said air flow communication member integrally connecting adjacent air injector nozzles, said plurality of air injector nozzles being spaced from each other along said air flow communication member, said air flow communication member extending in a substantially straight line, said air flow communication member extending in a substantially straight line beyond an air injector nozzle located at an end of said array of air injector nozzles, each of said air injector nozzles including an integral air injector tube, an integral connector plate, and a flow communication channel between the air flow communication member and the air injector tube, said flow communication channel being formed by an intersection of an inner diameter of the air injector tube and an inner diameter of the air flow communication member, said air injector tube being open at a first end and closed at a second end, said closed end of the air injector tube forming a portion of said connector plate and having an air injector hole in said closed end.

6. Nozzle apparatus adapted to be attached to a tub or spa for injection of air into the tub or spa, said nozzle apparatus comprising an array of air injector nozzles comprising an air flow communication member, and a plurality of air injector nozzles said air flow communication member integrally connecting adjacent air injector nozzles, said plurality of air injector nozzles being spaced from each other along said air flow communication member, said air flow communication member extending in a substantially straight line, said air flow communication member extending in a substantially straight line beyond an air injector nozzle located at an end of said array of air injector nozzles, each of said air injector nozzles including an integral air injector tube, an integral connector plate, and a flow communication channel between the air flow communication member and the air injector tube, said flow communication channel being formed by an intersection of an inner diameter of the air injector tube and an inner diameter of the air flow communication member, said air injector tube being open at a first end and closed at a second end, said closed end of the air injector tube forming a portion of said connector plate and having an air injector hole in said closed end, a sealing member attached to said open end of said air injector tube, an axial centerline of said air injector tube being spaced from an axial centerline of said air flow communication member.

7. The apparatus of claim 1, wherein said nozzle apparatus comprises at least two arrays of air injector nozzles, each array of air injector nozzles comprising an air flow communication member, and a plurality of air injector nozzles said at least two separate arrays of injector nozzles connected to each other by said flow communication member.

8. The nozzle apparatus of claim 1 wherein said array of air injector nozzles comprises at least two arrays of air injector nozzles being connected to each other by an angled connecting member, said angled connecting member comprising an individual air injector nozzle having an integral and angled flow tube.

9. A method for attaching nozzle apparatus to a tub or spa for injection of air into the tub or spa, said nozzle apparatus comprising an array of air injector nozzles comprising an air flow communication member, and a plurality of air injector nozzles said air flow communication member integrally connecting adjacent air injector nozzles, said plurality of air injector nozzles being spaced from each other along said air flow communication member, said air flow communication member extending in a substantially straight line, each of said air injector nozzles including an integral air injector tube, an integral connector plate, and a flow communication channel between the air flow communication member and the air injector tube, said flow communication channel being formed by an intersection of an inner diameter of the air injector tube and an inner diameter of the air flow communication member, said air injector tube being open at a first end and closed at a second end, said closed end of the air injector tube forming a portion of said connector plate, comprising the steps of:

connecting at least two arrays of air injector nozzles to each other in a configuration to be applied to said tub or spa.

10. A method for configuring the exact number of air injector nozzle apparatus called for to be applied to a tub or spa for injection of air into the tub or spa, said nozzle apparatus comprising an array of air injector nozzles comprising an air flow communication-member, and a plurality of air injector nozzles said air flow communication member integrally connecting adjacent air injector nozzles, said plurality of air injector nozzles being spaced from each other along said air flow communication member, said air flow communication member extending in a substantially straight line, each of said air injector nozzles including an integral air injector tube, an integral connector plate, and a flow communication channel between the air flow communication member and the air injector tube, said flow communication channel being formed by an intersection of an inner diameter of the air injector tube and an inner diameter of the air flow communication member, said air injector tube being open at a first end and closed at a second end, said closed end of the air injector tube forming a portion of said connector plate, comprising the steps of:

joining the appropriate number of arrays to equal the number of nozzles called for, where the number of joined arrays results in more individual nozzles than called for, selecting at least one of the arrays and cutting the flow communication member thereof between two adjacent nozzles in the array to achieve the exact number of individual air injection nozzles called for in the straight line; and joining the at least one cut array to the remaining arrays.

11. A method for configuring, joining and applying the exact number of air injector nozzle apparatus called for to be applied to a tub or spa in for injection of air into the tub or spa, said nozzle apparatus comprising comprising an array of air injector nozzles comprising an air flow communication member, and a plurality of air injector nozzles, said air flow communication member integrally connecting adjacent air injector nozzles, said plurality of air injector nozzles being spaced from each other along said air flow communication member, said air flow communication member extending in a substantially straight line, each of said air injector nozzles including an integral air injector tube, an integral connector plate, and a flow communication channel between the air flow communication member and the air injector tube, said flow communication channel being formed by an intersection of an inner diameter of the air injector tube and an inner diameter of the air flow communication member, said air injector tube being open at a first end and closed at a second end, said closed end of the air injector tube forming a portion of said connector plate, comprising the steps of:

temporarily joining the appropriate number of arrays to equal the number of nozzles called for, where the number of joined arrays results in more individual nozzles than called for, selecting at least one of the arrays and cutting the flow communication member thereof between two adjacent nozzles in the array to achieve the exact number of individual air injection nozzles called for, permanently joining the at least one cut array and the remaining arrays to each other using a flow connecting member; and applying the permanently joined arrays to the tub or spa.

* * * * *